United States Patent [19]

Mentcher

[11] 4,079,687

[45] Mar. 21, 1978

[54] TORPEDO TARGET ACQUISITION

[75] Inventor: Israel Mentcher, Weston, Conn.

[73] Assignee: General Electric Company, Pittsfield, Mass.

[21] Appl. No.: 129,493

[22] Filed: Aug. 1, 1961

[51] Int. Cl.[2] ..... F42B 19/00; F42B 19/10

[52] U.S. Cl. ..... 114/20 R

[58] Field of Search ..... 114/20, 21.1, 21.2, 114/23, 25, 22, 21, 24; 340/2, 3, 6; 102/18

[56] References Cited

U.S. PATENT DOCUMENTS

| | | | |
|---|---|---|---|
| 2,566,242 | 8/1951 | Naymik | 114/20 |
| 2,992,794 | 7/1961 | Boyd | 114/22 |
| 2,997,972 | 8/1961 | Abrams | 114/25 |
| 3,088,403 | 11/1963 | Bartling et al. | 114/22 |
| 3,115,833 | 12/1963 | Hall et al. | 102/18 |

*Primary Examiner*—Verlin R. Pendegrass
*Assistant Examiner*—Thomas H. Webb
*Attorney, Agent, or Firm*—Francis K. Richwine; John F. McDevitt

EXEMPLARY CLAIM

1. The method of acquiring a target with a torpedo comprising the steps of launching the torpedo into a target area, causing the torpedo to descend in a substantially vertical direction, actuating acoustic transducer means in order to detect the presence of a target while the torpedo is descending in said substantial vertical direction, and initiating an attack mode upon acquiring a target.

11 Claims, 9 Drawing Figures

Figure 1:
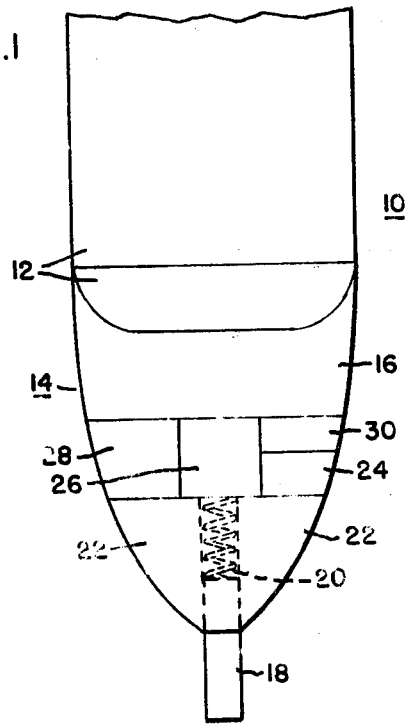

INVENTOR:
ISRAEL MENTCHER,
BY T. E. Kristoffersen
HIS ATTORNEY.

INVENTOR:
ISRAEL MENTCHER,

BY T. E. Kristofferson
HIS ATTORNEY.

TORPEDO TARGET ACQUISITION

This invention relates to an improved system for torpedo target acquisition and more particularly to such a system incorporating an acoustic acquisition subsystem which is separable from the torpedo and electrically entirely separate from the attack system and associated method.

In order to acquire a target, a torpedo must be designed to operate within ranges established by the limitations of the acoustical systems, fire control systems, relative torpedo and target speeds and other variables. In evaluating a particular acquisition system the accuracy of the fire control solution regarding bearing and range in either a Rocket Assisted Torpedo (RAT) or an aircraft launched torpedo is solely a function of sonar and fire control equipment and is a constant in the discussion of post water entry target acquisition, placing a constant limitation on the acquisition probability.

In the case of a RAT the time of flight or dead time will at least compound fire control errors and at worst permit evasive action to be taken if the target is alerted. The air flight dead time of a RAT however, is small compared to that of a torpedo requiring a pre-enabled run to the target area through water. In most cases target depth data is unreliable and consequently the torpedo must search the target area in depth in order to acquire.

Prior art solutions to this problem employ such approaches as helical searching, that is, ascending or decending in a helix where the depth rate and turn rate are determined by the search sonar ping repetition rate and the acoustic transmitting and receiving lobes. This type of search results in complete coverage of a cored cylinder and insures thorough acoustical coverage but uses a considerable amount of time to accomplish this coverage. In the case of one experimental torpedo, believed to have the most efficient search schedule of the helical type, 200 seconds are required to search to 1,000 feet. This may well be prohibitive in acquiring high speed, highly maneuverable future submarines which may go below 4,000 feet, even if we ignore the loss of valuable torpedo run time in acquiring the target which may be only slightly slower than the pursuing torpedo.

A second prior art approach employs laminar search which attempts to reduce target acquisition dead time by helically searching discrete discontinuous depth strata. This approach accepts a calculated risk of failing to acquire due to the holes in the acoustic pattern inherent in the search schedule.

Modern day developments involving nuclear propulsion and high speed hulls have compounded the acquisition problem. For example, a 25 knot submarine can get out of range of the most advanced torpedo acoustic system believed available unless it is acquired within 80 seconds after the torpedo enters the water, even if the fire control places the torpedo directly over the submarine. In addition, a 30 knot torpedo would require 360 seconds of pursuit run time to close a 3,000 ft. acquisition range target proceeding directly away from it at 25 knots. Under these conditions, the time involved and the running time lost through helical search become prohibitive. Equally unacceptable is the possibility of not acquiring the target at all which is inherent in the laminar system if the target is not at one of the preset strata.

The most advanced acoustic torpedoes known to be available are capable of approximately 30 knots and have an acoustic range of about 1,000 yards under optimum conditions. It would be reasonable to expect 40 knot torpedoes in the next few years and the development of low frequency acoustic systems compatible for maintaining adequate acoustic homing range at this speed. These are certainly necessary steps in achieving an effective anti-submarine warfare system to cope with the submarines of the near future.

There are a number of new acoustic control systems under development such as the smultaneous lobe comparison system disclosed in U.S. Pat. application Ser. No. 833,105 — Patterson filed 8/11/59, assigned to the same assignee as the present invention, and Doppler Homing which may result in attack systems superior in performance to the on-off steering used in the MK 32, 35 and 43 torpedoes. However, acquisition techniques are in relatively far greater need of a new approach. An on-off homing torpedo which has acquired a target within its speed capabilities has a hit capability between 70–80%. Raising this to 90% would achieve relatively much less than a substantial improvement in the acquisition probability, which may be as low as 30–40% against high speed targets.

In addition, prior art torpedoes have used a single acoustic system combining acquisition and attack capabilities. Such a combination necessitates making a compromise to optimize performance of both functions. Accordingly, it is an object of this invention to provide an acoustic acquisition subsystem capable of providing faster and more certain target acquisition.

Another object is to provide such an acquisition subsystem for detachable mounting on the nose of a torpedo.

Still another object is to provide such a subsystem for acquisition mechanically severable and electrically separate from the acoustic attack system.

A further object of the invention is to provide an acquisition subsystem and method capable of acquiring a target while descending straight down.

A still further object of the invention is to provide such a subsystem for acquisition capable of using either an active or passive transducer.

In carrying out the invention in one form thereof, an acoustic acquisition subsystem is provided with means for mounting it detachably over the smooth transducer nose of an acoustic homing torpedo. A transducer, which may be either active or passive is mounted in the nose of the acquisition subsystem and provided with means for extending it outwardly from the surface of the nose upon reaching a predetermined depth. A power source is provided capable of activating a transducer receiver. Weights are provided to allow for the desired negative buoyancy or sink rate. Means are provided to actuate a jettison mechanism upon target acquisition, and to further actuate the torpedo, as by means of a lanyard, to start its run and to commence its attack pattern. In the event a target is not acquired, means are provided to eject the subsystem at a present depth and to cause the torpedo to commence a preset search pattern. The system is set for the vertical search method described.

The novel features believed to be characteristic of the invention are set forth with particularity in the appended claims. The invention itself however, together with further objects and advantages thereof, can better be understood by reference to the following description, taken in connection with the accompanying drawings, wherein:

FIG. 1 is an outline drawing showing the components of an acquisition subsystem according to the invention, FIGS. 2A to 2D comprise a set of drawings illustrating operation of such a subsystem against high speed noisy targets, and FIGS. 3A to 3E comprise a second set of drawings illustrating operation against a low speed quiet target.

Turning now to the drawings, in FIG. 1 there is illustrated a torpedo 10 having a normal acoustic torpedo comprising the sections 12 and an acquisition subsystem 14 comprising the remaining portions. The acquisition subsystem is attached to torpedo 12 by means of a jettison and lanyard mechanism 16. Mechanism 16 includes means for jettisoning subsystem 14 from torpedo 12 such as explosive bolts or squibs, and a lanyard mechanism for actuating torpedo 12 when subsystem 14 is jettisoned.

In addition, acquisition subsystem 14 contains a transducer 18, which may be either an active or passive transducer. In one application a 30 kilocycle barium titanate transducer is employed. This transducer is mounted in such a manner that it may be extended by means such as spring 20 from its non operative position in which it is flush with the nose portion comprising weights 22. The spring 20 is actuated by means of a pressure trip switch 24 which is connected to release it. In addition, subsystem 14 contains a transistorized receiver 26 which is powered by a sea water battery 28 which may be of the type manufactured by General Electric for the MK 44 torpedo. The receiver 26 is so designed that it is immediately activated by the battery 28, that is the receiver 26 has a very short warm-up time. It is further designed to provide an output signal to the jettison mechanism 16 when the transducer 18 acquires a target. In the event a target is not acquired, a preset jettison depth switch 30 is provided for jettisoning subsystem 14 upon reaching a certain preset maximum depth. If this occurs, torpedo 12 may be programmed to execute a spiraling ascending search pattern. If the subsystem 14 acquires a target and is jettisoned, torpedo 12 may be programmed to execute a flat turn and in doing so to acquire the target and attack.

The assembly 14 is secured to torpedo 12 in such a manner that the smooth skin surface of the torpedo nose secton is retained. Weights 22 are sufficient to provide nose down trim to cause a 30 ft. per second sinking rate.

Propulsion power will not be turned on during the sink search. This will serve to minimize interference with the acoustical portion of the system, particularly where a sensitive passive transducer is being employed. Another advantage is that the absence of propulsion noise will keep the target unalerted.

Drag calculations on one experimental torpedo indicate that this sinking rate can be achieved with approximately 130 lbs. of vehicle negative buoyancy.

Transducer 18 in one configuration will be a passive, low frequency, omnidirectional transducer made of barium titanate. For example, the SSQ-15 sonobuoy transducer which operates in the 30 KC region, is approximately 15 inches long and 2½ inches in diameter, weighs approximately 4 lbs. and has a receiving sensitivity of 85–90 db below 1 volt/dyne/cm$^2$, may be used. An active transducer may be employed to increase the probability of acquiring during descent, particularly if the target is silent. Typical passive acoustic transducers can acquire a target from 3,000–4,000 yards. The best active transducer known to be available has about a 1500 yard range. An example of this is the transducer used on the MK 44 MOD 2 torpedo. The pressure switch 24 may be set to extend the transducer at 50 ft. in depth. This has an advantage of permitting the Beeline acquisition head to take high water entry shock. There are no electrical connections between torpedo 12 and assembly 14.

FIGS. 2A to 2D and 3A to 3E illustrate two operation sequences of the mechanism illustrated in FIG. 1. FIGS. 2A to 2D illustrate operation against a high speed noisy target. The torpedo having an acquisition subsystem such as 14 in FIG. 1 is either RAT launched from a ship or dropped from an aircraft in the target area.

Figure 2A:
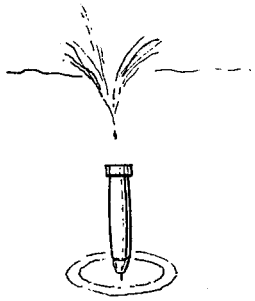
Figure 2A:
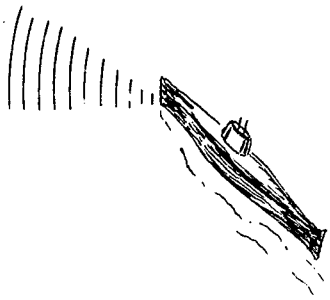
Figure 2B:
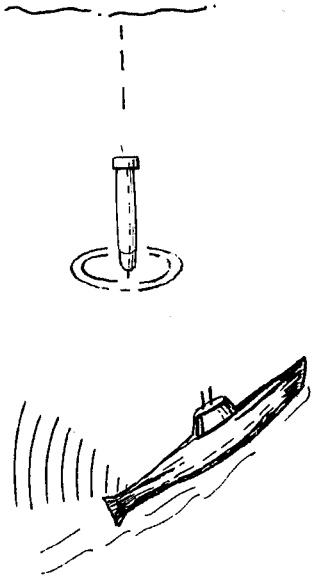
Figure 2C:
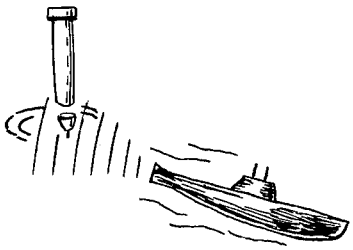
Figure 2D:
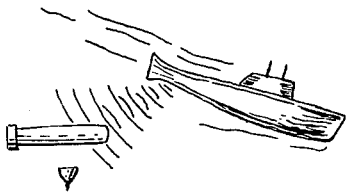

The electronic circuits in the torpedo proper can be activated at the time of fire to insure warm-up before the target is acquired. As the torpedo enters the water, such as in FIG. 2A, it begins nose down free fall at a rate of approximately 30 feet per second. The sea water battery 28 is activated, supplying power to transistorized receiver 26 which does not require warm-up time. When the torpedo reaches 50 feet, pressure switch 24 extends transducer 18 by means of spring 20. Again this is at the depth illustrated in FIG. 2A. The torpedo then will proceed to sink at 30 feet per second while the passive transducer 18 listens to acquire a target as in FIG. 2B. Since the torpedo propulsion machinery is not on, the listening range should be excellent due to the extremely quiet platform. If the target is noisy when the torpedo reaches target depth, as in FIG. 2C, the transducer 18 receiver 26 combination detects and generates a signal indicating presence of the target, the output signal from receiver 26 activates jettison and lanyard mechanism 16, jettisoning acquisition subsystem 14 and enerizing torpedo 12 propulsion and control. Torpedo 12 is programmed to go into an active pinging flat search turn during which it should acquire the target. If it does not it can be programmed to commence a downward helical search. The jettisoning and activation is shown in FIG. 2D.

Figure 3A:
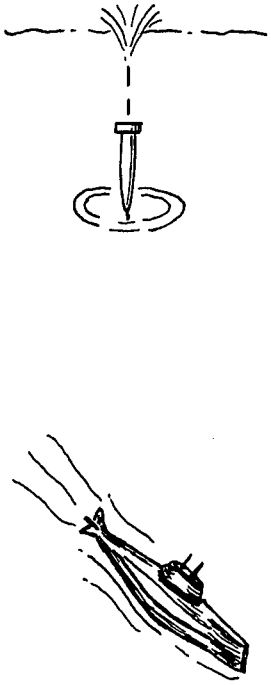
Figure 3B:
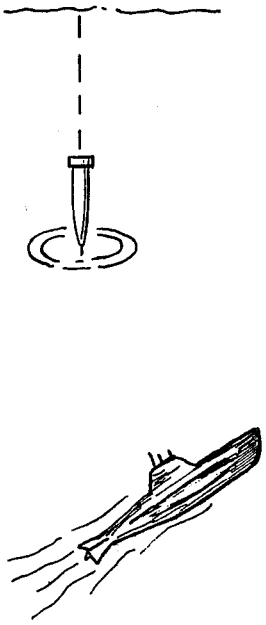
Figure 3C:
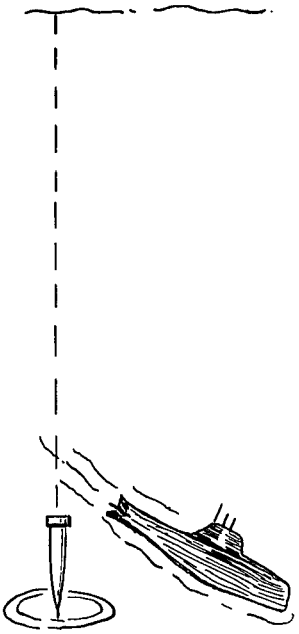
Figure 3D:
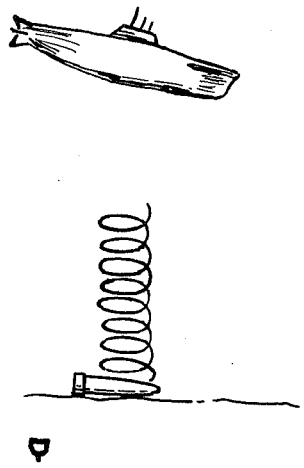
Figure 3E:
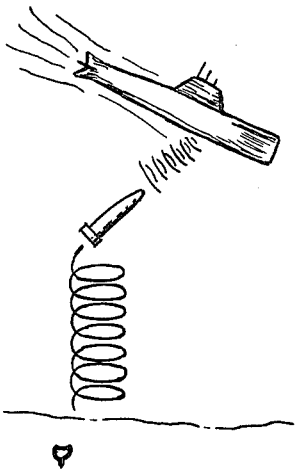

Turning now to FIGS. 3A to 3E which illustrate operating against a low speed quite target, the steps illustrated in FIGS. 3A and 3B are similar to those of 2A and 2B with the exception that sufficient noise is not emanating from the target.

As illustrated in 3C, the torpedo passes the target in depth without acquiring it and then as illustrated in 3D, it reaches the preset jettison depth at which switch 30 jettisons subsystem 14 pulling the lanyard and activating torpedo 12 which is programmed to commence an upward helical search pattern. As the target is a low noise target, moving slowly or hovering, the acquisition should be made during the upward helical search such as illustrated in 3E. In this manner it appears reasonable to assume that fast, noisy targets will be acquired passively on the way down and slow, quite targets will be acquired actively on the way up. Vertical search is referred to as Beeline.

Beeline search is capable of increasing the speed of depth acquisition by a factor of 6 over helical search systems as well as being capable of eliminating the risk of losing targets which is present in the laminar search system. When the acquisition is accomplished during descent it will make all of the torpedo run time available for pursuit. Present torpedos often use 20–40% of the available running time during acquisition.

The acquisition subsystem could also be mounted permanently on the torpedo as for instance in a girdle around the torpedo which is not detachable. Such an arrangement would have the disadvantage that enough ballast could not be conveniently used for sinking without propulsion power or the attack phase would be hindered. If propulsion were used it might also be necessary to use an active transducer. All this would serve to make the torpedo more easily detectable by the target. Again, downward propulsion also uses up running time.

While particular embodiments of the invention have been illustrated and discussed it will be understood, of course, that it is not intended to limit the invention thereto, since many modifications may be made and it is therefore contemplated to cover any such modifications by the appended claims as fall within the true spirit and scope of the invention.

What is claimed as new and desired to be secured by Letters Patent of the United States is:

1. The method of acquiring a target with a torpedo comprising the steps of launching the torpedo into a target area, causing the torpedo to descend in a substantially vertical direction, actuating acoustic transducer means in order to detect the presence of a target while the torpedo is descending in said substantial vertical direction, and initiating an attack mode upon acquiring a target.

2. The method of acquiring a target with a torpedo comprising the steps of launching the torpedo into a target area, causing the torpedo to descend in a substantially vertical direction, actuating acoustic transducer means in order to detect the presence of a target while the torpedo is descending in said substantial vertical direction, initiating an ascending search pattern in the event a target is not acquired during descent to a preset depth, and initiating an attack mode upon acquiring a target.

3. The method of acquiring a target with a torpedo having an acquisition subsystem comprising the steps of launching the torpedo into a target area, causing the torpedo to descend in a substantially vertical direction, actuating acoustic transducer means in order to detect the presence of a target while the torpedo is descending in said substantial vertical direction, jettisoning the acquisition subsystem and initiating an attack mode upon acquiring a target.

4. The method of acquiring a target with a torpedo having an acquisition subsystem comprising the steps of launching the torpedo into a target area, causing the torpedo to descend in a substantially vertical direction, actuating acoustic transducer means in order to detect the presence of a target while the torpedo is descending in said substantial vertical direction, jettisoning the acquisition subsystem at a preset depth upon failure to acquire a target during descent, commencing an upward active search, and initiating an attack mode upon acquiring a target.

5. The method of acquiring a target with a torpedo having an acquisition subsystem comprising the steps of launching the torpedo into a target area, causing the torpedo to descend in a substantially vertical direction, actuating an acoustic transducer in the subsystem and extending the transducer upon reaching a predetermined depth in order to detect the presence of a target while the torpedo is descending in said substantial vertical direction, jettisoning the acquisition subsystem and initiating an attack mode upon acquiring a target.

6. The method of acquiring a target with a torpedo comprising the steps of launching the torpedo into a target area, providing the torpedo with an acquisition subsystem weighted to provide a predetermined sinking rate and trim to cause the torpedo to descend in a substantially vertical direction, actuating acoustic transducer means in the subsystem in order to detect the presence of a target while the torpedo is descending in said substantial vertical direction, jettisoning the acquisition subsystem, and initiating an attack mode upon acquiring a target.

7. In a torpedo target acquisition system comprising a torpedo and a target acquisition subsystem an improved acquisition subsystem comprising jettison means detachably connecting said subsystem to said torpedo capable of jettisoning said subsystem and actuating torpedo attack on command, a transducer having a power source and an associated receiver connected thereto, a jettison depth switch sensitive to depth and adjustable to jettison said subsystem at a predetermined depth connected to actuate said jettison means, said receiver being connected to said jettison means to actuate said jettison means upon receipt of a target signal to jettison said subsystem and initiate an attack mode.

8. In a torpedo target acquisition system comprising a torpedo and a target acquisition subsystem an improved acquisition subsystem comprising jettison means detachably connecting said subsystem to said torpedo capable of jettisoning said subsystem and actuating torpedo attack on command, a passive transducer having a power source and an associated receiver connected thereto, a jettison depth switch sensitive to depth and adjustable to jettison said subsystem at a predetermined depth connected to actuate said jettison means, said receiver being connected to said jettison means to actuate said jettison means upon receipt of a target signal to jettison said subsystem and initiate an attack mode.

9. In a torpedo target acquisition system comprising a torpedo and a target acquisition subsystem an improved acquisition subsystem comprising jettison means detachably connecting said subsystem to said torpedo capable of jettisoning said subsystem and actuating torpedo attack on command, a transducer having a power source and an associated receiver connected thereto, a pressure trip switch, means for extending said transducer outwardly from said subsystem in response to actuation of said pressure trip switch, a jettison depth switch sensitive to depth and adjustable to jettison said subsystem at a predetermined depth connected to actuate said jettison means, said receiver being connected to said jettison means to actuate said jettison means upon receipt of a target signal to jettison said subsystem and initiate an attack mode.

10. In a torpedo target acquisition system comprising a torpedo and a target acquisition subsystem an improved acquisition subsystem comprising a transducer having a power source and an associated receiver connected thereto, means activating said power source upon water entry and means for causing said system to descend at a predetermined rate in a substantially vertical direction.

11. In a torpedo target acquisition system comprising a torpedo and a target acquisition subsystem an improved acquisition subsystem comprising a transducer having a power source and an associated receiver connected thereto, means activating said power source upon water entry, means for causing said system to descend at a predetermined rate in a substantially vertical direction and means causing at least the torpedo portion of said system to rise in a search pattern after reaching a predetermined depth in the absence of acquiring a target.

* * * * *